US010524969B2

(12) United States Patent
Ishikawa

(10) Patent No.: US 10,524,969 B2
(45) Date of Patent: Jan. 7, 2020

(54) RAMP AND VEHICLE RAMP DEVICE

(71) Applicant: Toyota Jidosha Kabushiki Kaisha, Toyota-shi, Aichi-ken (JP)

(72) Inventor: Hironari Ishikawa, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/870,570

(22) Filed: Jan. 12, 2018

(65) Prior Publication Data

US 2018/0256421 A1 Sep. 13, 2018

(30) Foreign Application Priority Data

Mar. 9, 2017 (JP) ..... 2017-044986

(51) Int. Cl.
*A61G 3/06* (2006.01)

(52) U.S. Cl.
CPC ..... *A61G 3/067* (2016.11); *A61G 3/061* (2013.01); *A61G 3/068* (2016.11)

(58) Field of Classification Search
CPC ..... A61G 3/061; A61G 3/067; A61G 3/068
See application file for complete search history.

(56) References Cited

U.S. PATENT DOCUMENTS 2,587,265 A * 2/1952 Wright ..... B60P 1/43 182/223
2,966,274 A * 12/1960 Edwin ..... B60P 1/43 414/556
4,020,957 A * 5/1977 Wren ..... B60P 3/07 14/71.1
4,144,979 A * 3/1979 Leach, Jr. ..... B62D 63/061 14/71.1
4,372,727 A * 2/1983 Fredrickson ..... B60P 1/433 296/61
4,647,270 A * 3/1987 Maloney ..... B60P 1/43 296/61
5,137,114 A * 8/1992 Yde ..... E04F 11/002 14/71.1
6,186,734 B1 * 2/2001 Maurer ..... B60P 1/43 14/71.1

(Continued)

FOREIGN PATENT DOCUMENTS

GB 2268133 A 1/1994
JP 2006123661 A 5/2006

(Continued)

*Primary Examiner* — Saul Rodriguez
*Assistant Examiner* — Ashley K Romano
(74) *Attorney, Agent, or Firm* — Dinsmore & Shohl LLP

(57) ABSTRACT

A ramp includes: a ramp body having a ramp face; and support members that, when the ramp body is used, are each disposed at a respective width direction end of the ramp body so as to run along an extension direction of the ramp body including at an extension direction central portion of the ramp body, the width direction being orthogonal to the extension direction of the ramp body, the support members respectively forming triangular shapes having heights that decrease on progression from one end portion side to another end portion side in the extension direction of the ramp body in side view, and a lower end of each of the support members making contact with a ground contact surface so as to support the ramp body from a lower side.

12 Claims, 8 Drawing Sheets

(56) References Cited

U.S. PATENT DOCUMENTS

| | | | | |
|---|---|---|---|---|
| 6,533,337 | B1 * | 3/2003 | Harshman | B60P 1/43 224/403 |
| 6,536,822 | B1 * | 3/2003 | Vagedes | B60P 1/435 296/26.08 |
| 7,150,487 | B2 * | 12/2006 | Devitt | B60P 1/433 296/61 |
| 7,373,676 | B2 * | 5/2008 | Markovic | A61N 5/1049 378/209 |
| 7,404,697 | B2 * | 7/2008 | Thompson | E21B 19/155 414/22.58 |
| 7,497,494 | B1 * | 3/2009 | Good | B60P 1/433 14/71.3 |
| 9,545,866 | B2 * | 1/2017 | Woods, Sr. | B60P 1/433 |
| 9,562,358 | B2 * | 2/2017 | Lanphear | E04F 11/06 |
| 9,587,405 | B1 * | 3/2017 | Alhazza | E04F 11/002 |
| 2008/0184502 | A1 * | 8/2008 | Roberts | A61G 3/061 14/71.1 |
| 2012/0237326 | A1 * | 9/2012 | Van Ness | A61G 3/0236 414/507 |
| 2016/0374876 | A1 * | 12/2016 | Thornton | A61G 3/061 14/69.5 |
| 2017/0340493 | A1 * | 11/2017 | Sidhu | B60P 1/435 |
| 2018/0086261 | A1 * | 3/2018 | Sugimoto | B60Q 3/51 |

FOREIGN PATENT DOCUMENTS

| | | | |
|---|---|---|---|
| JP | 2010190027 | A | 9/2010 |
| JP | 5102010 | B2 | 12/2012 |

* cited by examiner

RAMP AND VEHICLE RAMP DEVICE

CROSS-REFERENCE TO RELATED APPLICATION

This application is based on and claims priority under 35 USC 119 from Japanese Patent Application No. 2017-044986 filed on Mar. 9, 2017, the disclosure of which is incorporated by reference herein.

BACKGROUND

Technical Field

The present disclosure relates to a ramp and a vehicle ramp device.

Related Art

Japanese Patent No. 5102010, for example, describes technology relating to a vehicle ramp device that is deployed rearward from the rear end of a vehicle. The vehicle ramp device includes a slide mechanism and a folding mechanism. A ramp member (ramp) is configured so as to be capable of sliding using the slide mechanism, and sliding the ramp member enables the ramp member to be deployed and stowed.

Support legs that support the ramp member are configured so as to be foldable with respect to the ramp member using the folding mechanism, thereby enabling the support legs to be deployed and stowed. In a deployed state, the support legs contact the ground so as to support the ramp member.

However, in Japanese Patent No. 5102010, the support legs are rod-shaped bodies, and a leading end portion of each support leg makes contact with the ground. Accordingly, stress is liable to concentrate on the ramp member side through the support leg. It is thus necessary to increase the plate thickness of the ramp member in order to suppress deformation of the ramp member itself. However, this increases the weight of the ramp.

SUMMARY

In consideration of the above circumstances, exemplary embodiments provide a ramp and a vehicle ramp device in which the support rigidity of the ramp can be raised while suppressing an increase in the weight of the ramp.

A ramp of a first aspect includes a ramp body having a ramp face, and support members. When the ramp body is used, each support member is disposed at a respective width direction end of the ramp body so as to run along an extension direction of the ramp body including at an extension direction central portion of the ramp body, with the width direction being orthogonal to the extension direction of the ramp body. The support members respectively form triangular shapes having heights that decrease on progression from one end portion side to another end portion side in the extension direction of the ramp body in side view. A lower end of each of the support members makes contact with a ground contact surface so as to support the ramp body from a lower side.

The ramp of the first aspect is configured such that when the ramp body having the ramp face is used, the ramp body is supported by the support members from the lower side. Each support member is disposed so as to run along an extension direction of the ramp body, including at the extension direction central portion of the ramp body. The support members respectively form triangular shapes having heights that decrease on progression from the one end portion side to the other end portion side in the extension direction of the ramp body in side view. The support members support the ramp body from the lower side in a state in which the lower end of each support member has made contact with the ground contact surface.

For example, in cases in which support portions (which differ from the support members) to support a ramp body are provided only at an extension direction central portion of the ramp body, load acting on the ramp body is concentrated at the extension direction central portion of the ramp body due to the presence of the support portions. Moreover, since support portions are not provided between an extension direction front end of the ramp body and the support portions, or between an extension direction rear end of the ramp body and the support portions, there is a concern regarding flexure of the ramp body in these regions. If the plate thickness of the ramp body is increased in an attempt to raise the rigidity of the ramp body so as to alleviate this concern, the weight of the ramp is increased by a commensurate amount.

In contrast thereto, in some embodiments, as described above, since the support members are disposed so as to extend along the extension direction of the ramp body, including at the extension direction central portion of the ramp body, load acting on the ramp body is dispersed compared to cases in which the support members are provided only at the extension direction central portion of the ramp body, consequently enabling the support rigidity of the ramp body to be raised.

Namely, in some embodiments, disposing the support members along the extension direction of the ramp body enables support force to be obtained over a wide range of the ramp body, and enables the suppression of flexure in the ramp body. Namely, the overall rigidity of the ramp with the support members is increased, thus enabling the plate thickness of the ramp body to be thinned by a commensurate amount. This enables the weight of the ramp to be reduced.

Note that the "triangular shapes" referred to herein mean so-called "substantially triangular shapes". Accordingly, for example, support members shaped having cut-off apexes at the other end portion side in the extension direction of the ramp body suffice so long as they form a triangular shape overall.

A ramp of a second aspect is the ramp of the first aspect, wherein at least one of a leading end portion or a rear end portion in the extension direction of the ramp body is provided with a hinge panel that is configured to adjust an angle formed between the hinge panel and the ramp face.

In the ramp of the second aspect, at least one of the leading end portion or the rear end portion in the extension direction of the ramp body is provided with a hinge panel, and the hinge panel is configured such that an angle formed with the ramp face of the ramp body is adjustable. This enables dimensional adjustments to be made between a dimension of the support members in the height direction and a dimension of the ramp body along the extension direction.

A ramp of a third aspect is the ramp of the first aspect or the second aspect, wherein the support members are stowed in a state folded against the ramp body, and the ramp body is configured so as to be usable in a state in which the support members have been deployed in the width direction of the ramp body.

In the ramp of the third aspect, the support members are set so as to be stowed in a state folded against the ramp body, and the support members are configured to deploy in the width direction of the ramp body. Namely, from the stowed state, the support members are deployed from the inner side toward the outer side in the width direction of the ramp body, or the support members are deployed from the outer side toward the inner side in the width direction of the ramp body. Thus, due to stowing the support members in a state folded against the ramp body, storability of the ramp is improved compared to cases in which the support members do not fold up.

A ramp of a fourth aspect is the ramp of any one of the first aspect to the third aspect, wherein each of the support members is provided with a first shaft running along the extension direction of the ramp body at the respective width direction end of the ramp body, and the support members are configured so as to be rotatable about the first shafts.

In the ramp of the fourth aspect, each support member is provided with the first shaft running along the extension direction of the ramp body at the respective width direction end portion of the ramp body, and the support members are configured so as to be rotatable about the first shafts. The support members are thus able to be stowed or deployed using a simple configuration.

A ramp of a fifth aspect is the ramp of any one of the first aspect to the third aspect, wherein each of the support members comprises: a support wall and a hinged wall. The support wall is configured so as to be rotatable in the width direction of the ramp body, and forms a triangular shape in side view and has a free end portion that makes contact with the ground contact surface in a state in which the support member has been deployed. The hinged wall, together with the support wall, font's a closed cross-section in a state in which the support member has been deployed, and folds toward an inside of the closed cross-section when stowing the support member.

In the ramp of the fifth aspect, each support member is configured including the support wall and the hinged wall. The support wall is configured so as to be rotatable in the width direction of the ramp body, and forms a triangular shape in side view and the free end portion of the support wall makes contact with the ground contact surface in a state in which the support member has been deployed. The hinged wall, together with the support wall, forms a closed cross-section in a state in which the support member has been deployed, and folds toward the inside of the closed cross-section when stowing the support member. Namely, when stowing the support members, the hinged walls fold inward accompanying rotating of the support walls, thereby folding the support members.

A ramp of a sixth aspect is the ramp of any one of the first aspect to the fifth aspect, wherein the ramp body comprises: a first ramp member; and a second ramp member in which the support members are stowed. The second ramp member is configured to adopt a stowed state in which the second ramp member and the first ramp member overlap in a plate thickness direction and, and the second ramp member slides relative to the first ramp member along the extension direction of the ramp body so as to deploy to a leading end side of the first ramp member.

In the ramp of the sixth aspect, the ramp body is configured including the first ramp member and the second ramp member. In a state in which the support members are stowed against the second ramp member, the second ramp member and the first ramp member are overlapped in the plate thickness direction, thereby adopting the stowed state. During deployment, the second ramp member slides relative to the first ramp member along the extension direction of the ramp body so as to be disposed at the leading end side of the first ramp member.

In this manner, the second ramp member stowing the support members is stowed overlapping with the first ramp member in the plate thickness direction, thereby enabling the first ramp member, the second ramp member, and the support members to be compactly consolidated in the plate thickness direction.

Namely, in one embodiment, in a state in which the first ramp member is placed on the ground contact surface, the ramp body can be stowed and deployed just by sliding the second ramp member in a horizontal direction. Accordingly, convenience is increased compared to cases in which, for example, the second ramp member is swung with respect to the first ramp member so as to be stowed or deployed.

Note that, in addition to a state in which the first ramp member and the second ramp member are simply overlapped in the plate thickness direction, a "stowed state in which the second ramp member and the first ramp member overlap in a plate thickness direction" encompasses, for example, providing a rail on the side of the first ramp member to allow the second ramp member to slide so as to store the second ramp member in the first ramp member in a state in which the first ramp member and the second ramp member overlap in the plate thickness direction.

A ramp of a seventh aspect is the ramp of any one of the first aspect to the fifth aspect, further including a first fold line and a second fold line. The first fold line is provided at the ramp body, the first fold line is provided running along the width direction of the ramp body, and the first fold line is a point about which the ramp body folds so as to compress in the extension direction. The second fold line is provided at the support members at a different position in the plate thickness direction of the ramp body from the first fold line, and the second fold line is a point about which the support members fold to a width direction inner side of the ramp body.

In the ramp of the seventh aspect, the first fold line is provided at the ramp body, and the ramp body is able to fold about the first fold line so as to compress in the extension direction. The second fold line is provided at the support members at a different position in the plate thickness direction of the ramp body from the first fold line, and the support members is able to fold to the width direction inner side of the ramp body about the second fold line.

Namely, configuration is such that when stowing or deploying the ramp body, the ramp body and the support member do not interfere with each other. This enables the support member to be deployed accompanying operation of the ramp body when, for example, deploying the ramp body after the ramp body has been compressed.

A vehicle ramp device of an eighth aspect includes the ramp of any one of the first aspect to the seventh aspect, the ramp being connected to a connecting portion provided at a rear end of a vehicle. The vehicle ramp device is configured such that the ramp is rotatable in a vehicle front-rear direction about a second shaft provided running along a vehicle width direction at the connecting portion.

In the vehicle ramp device of the eighth aspect, the ramp is connected to the connecting portion provided at the rear end of a vehicle. The second shaft is provided running along the vehicle width direction at the connecting portion, and the ramp is configured so as to be rotatable in the vehicle front-rear direction about the second shaft. When the ramp (ramp body) is swung toward the vehicle rear, the leading end portion of the ramp body makes contact with the ground contact surface.

The floor section of the loading compartment provided at a rear portion of the vehicle and the ground contact surface are thus bridged by the ramp body such that the floor face in the loading compartment and the ground contact surface are formed so as to be continuous with one another across the ramp face of the ramp body. In this state, the lower ends of the support members of the ramp make contact with the ground contact surface so as to support the ramp body from the lower side.

A vehicle ramp device of an ninth aspect is the vehicle ramp device of the eighth aspect, wherein in a stowed state of the ramp, the ramp is disposed in an upstanding state in a loading compartment provided at a rear portion of the vehicle.

In the vehicle ramp device of the ninth aspect, the ramp is stowed in an upstanding state in the loading compartment provided at the rear portion of the vehicle, thus enabling the ramp to be compactly stored in the loading compartment, and enabling the loading space to be enlarged by a commensurate amount.

As described above, the ramp according to the first aspect exhibits the excellent effect of enabling support rigidity of the ramp to be raised while suppressing an increase in the weight of the ramp.

The ramp according to the second aspect exhibits the excellent effect of enabling dimensional adjustments to be made, via the hinge panel, between a dimension of the support members in the height direction and a dimension of the ramp body along the extension direction.

Due to stowing the support members in a state folded against the ramp body, the ramp according to the third aspect exhibits the excellent effect of improving the storability of the ramp compared to cases in which the support members are not folded up.

The ramp according to the fourth aspect exhibits the excellent effect of enabling the support members to be stowed or deployed using a simple configuration.

Due to the hinged walls folding inward accompanying rotating of the support walls, the ramp according to the fifth aspect exhibits the excellent effect of enabling the support members to be folded in a simple manner when stowing the support members.

The ramp according to the sixth aspect exhibits the excellent effect of enabling the first ramp member, the second ramp member, and the support members to be compactly consolidated in the plate thickness direction.

The ramp according to the seventh aspect exhibits the excellent effect of enabling the support member to be deployed accompanying a deployment operation of the ramp body.

The vehicle ramp device according to the eighth aspect exhibits the excellent effect of enabling the feeling of stability of the ramp to be increased due to the ramp being connected to the rear end of the vehicle.

The vehicle ramp device according to the ninth aspect exhibits the excellent effect of enabling the ramp to be compactly stored in the loading compartment, and enabling the loading space to be enlarged by a commensurate amount.

BRIEF DESCRIPTION OF THE DRAWINGS

Exemplary embodiments of the present application will be described in detail based on the following figures, wherein.

DETAILED DESCRIPTION

Explanation follows regarding examples of a vehicle ramp device according to exemplary embodiments of the present application, with reference to the drawings. Note that the arrow FR indicates the front in the vehicle front-rear direction, the arrow RH indicates the right in the vehicle width direction, the arrow LH indicates the left in the vehicle width direction, and the arrow UP indicates upwards in the vehicle vertical direction. Moreover, in the following explanation, unless specifically stated otherwise, reference to the front-rear, left-right, and up-down directions respectively indicates front-rear in the vehicle front-rear direction, left-right in the vehicle left-right direction, and up-down in the vehicle vertical direction.

First Exemplary Embodiment

Vehicle Ramp Device Configuration

First, explanation follows regarding a vehicle ramp device according to a first exemplary embodiment of the present application.

Figure 1:
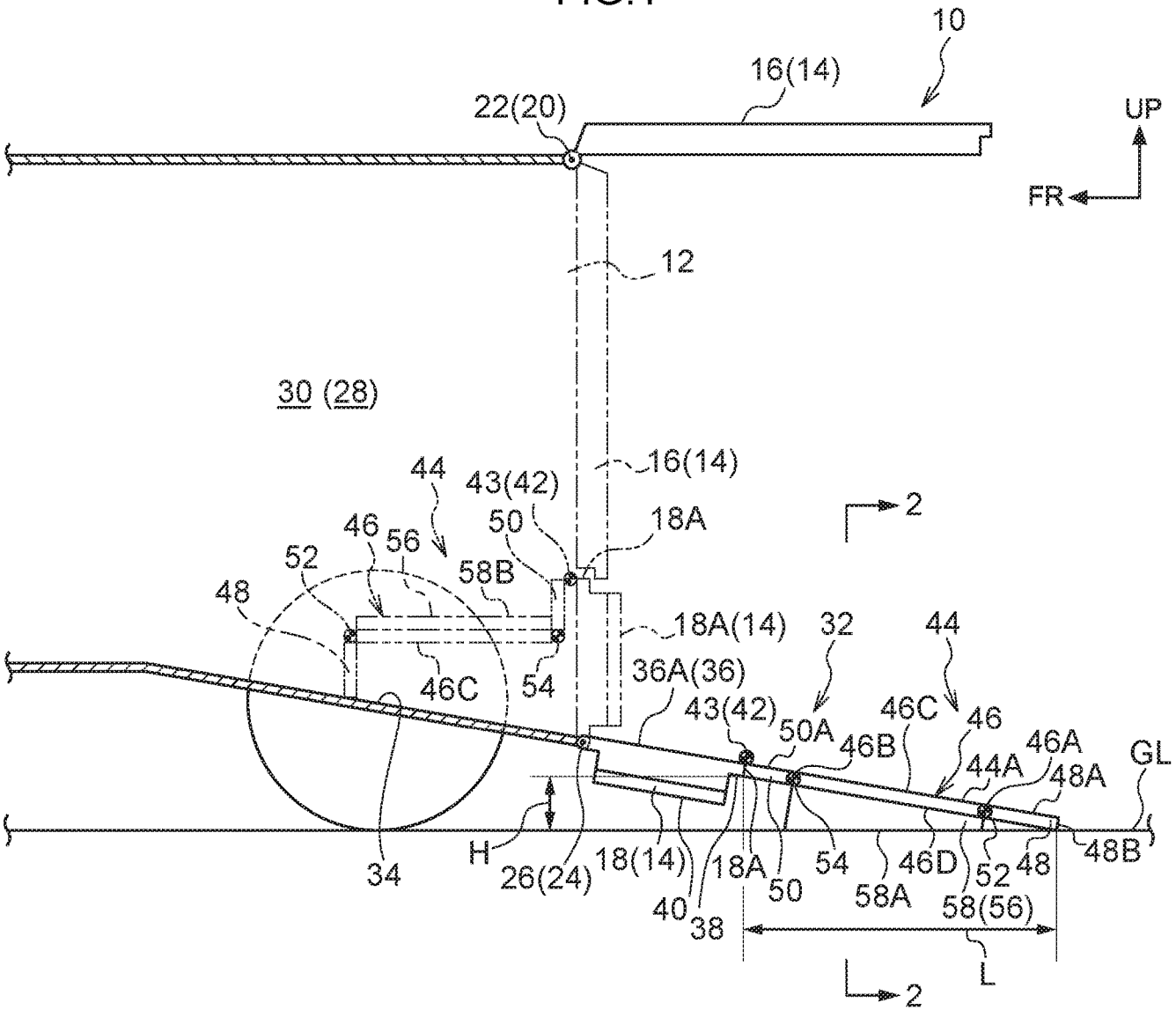
FIG. 1 is a schematic side view illustrating a vehicle ramp device according to a first exemplary embodiment, in which a deployed state of a ramp is illustrated using solid lines and a stowed state of the ramp is illustrated using double-dotted dashed lines.

As illustrated in FIG. 1, a back door opening 12 is formed at the rear end of a vehicle 10. The back door opening 12 is configured so as to be capable of being opened up or closed off by a back door 14. The back door 14 is divided into two sections above and below each other in the vehicle vertical direction, and is configured including an upper back door 16 that opens up and closes off an upper side of the back door opening 12, and a lower back door (referred to below as a "tailgate") 18 that opens up and closes off a lower side of the back door opening 12.

An upper door hinge 20 is provided to each vehicle width direction end portion of an upper peripheral portion of the back door opening 12. A shaft 22 is provided running along the vehicle width direction in each upper door hinge 20. The upper back door 16 is supported by the shafts 22 so as to be rotatable. The upper back door 16 can be opened or closed about the shafts 22 with respect to the upper portion of the back door opening 12.

Further, a lower door hinge 24 is provided to each vehicle width direction end portion of a lower peripheral portion of the back door opening 12. A shaft 26 is provided running along the vehicle width direction in each lower door hinge 24. The tailgate 18 is supported by the shafts 26 so as to be rotatable. The tailgate 18 can be opened or closed about the shafts 26 with respect to the lower portion of the back door opening 12. Note that the tailgate 18 is capable of opening up or closing off the lower portion of the back door opening 12 in a state in which the upper back door 16 has been left open.

A rear portion of a vehicle cabin 28 configures a loading space (referred to below as a "loading compartment") 30 in the vehicle 10 of the first exemplary embodiment. The loading compartment 30 is configured such that a wheelchair (not illustrated in the drawings), for example, can be fixed in place inside the loading compartment 30. The vehicle 10 is therefore provided with a ramp (vehicle ramp device) 32, and a floor section 34 of the loading compartment 30 is configured by an inclined face that is angled gently downward on progression toward the vehicle rear.

The tailgate 18 is configured including a tailgate inner panel 36 that configures a vehicle inside of the tailgate 18, and a tailgate outer panel 38 that configures an upper portion on the vehicle outside of the tailgate 18. A bumper 40 is provided to a lower portion on the vehicle outside of the tailgate 18. Note that in the first exemplary embodiment, the tailgate inner panel 36 configures a ramp face 36A that is continuous with a ramp face 44A of a ramp 44. Namely, in the first exemplary embodiment, the tailgate inner panel 36 and the ramp 44 configure the vehicle ramp device 32.

A pair of connecting portions 42 that run along the vehicle width direction are provided at a free end portion 18A of the tailgate 18, and the ramp 44 is connected to the connecting portions 42. Shafts (second shafts) 43 that run along the vehicle width direction are provided to the connecting portions 42, and the ramp 44 is rotatable in the vehicle front-rear direction about the shafts 43.

Ramp Configuration

Explanation follows regarding the ramp according to the first exemplary embodiment.

As illustrated in FIG. 1, the ramp 44 is configured including a ramp body 46, and hinge panels 48, 50 respectively provided at an extension direction leading end 46A side (ground contact surface GL side) and an extension direction rear end 46B side (connecting portions 42 side) of the ramp body 46.

To explain in detail, hinges 52 are provided at the leading end 46A of the ramp body 46, and the hinge panel 48 is connected to the leading end 46A of the ramp body 46 via the hinges 52. In addition, hinges 54 are provided at the rear end 46B of the ramp body 46, and the hinge panel 50 is connected to the rear end 46B of the ramp body 46 via the hinges 54. Note that the hinges 52, 54 are, for example, configured by the butterfly hinges illustrated in FIG. 3C. Similar applies to the other hinges mentioned below, and so explanation thereof is omitted.

The hinge panels 48, 50 are configured such that the angles (not illustrated in the drawings) respectively formed between the ramp faces 48A, 50A on the top side of the hinge panels 48, 50 and the ramp face 46C on the top side of the ramp body 46 can be adjusted via the hinges 52, 54.

Further, support members 56 are provided on a back face 46D side of the ramp body 46 so as extend across substantially the entire extension direction range of the ramp body 46 from the leading end 46A to the rear end 46B of the ramp body 46, and the support members 56 are provided so as to be able to be deployed and stowed. Detailed explanation follows regarding the support members 56.

Figure 2:
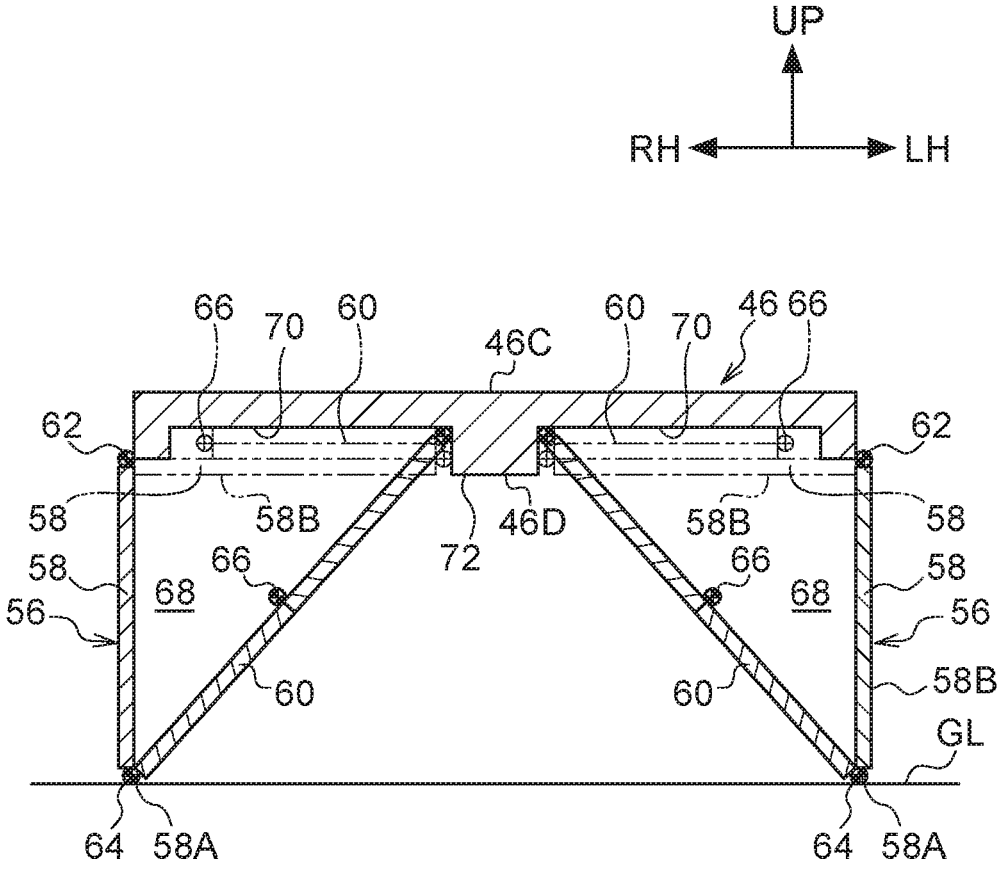
FIG. 2 is a cross-section illustrating a state sectioned along line 2-2 in FIG. 1, in which a deployed state of a support member supporting the ramp is illustrated using solid lines and a stowed state of the support member is illustrated using double-dotted dashed lines.

As illustrated in FIG. 2, each support member 56 is configured including a support wall 58 and a hinged wall 60. Hinges 62 are provided at each width direction end of the ramp body 46, and each support wall 58 is rotatable in the width direction of the ramp body 46 about the respective hinges 62.

In a state in which the support walls 58 have been stowed, as illustrated by the double-dotted dashed lines in FIG. 2, each support wall 58 is disposed so as be overlapped on the back face 46D side of the ramp body 46. In a state in which the support walls 58 have been deployed, as illustrated by the solid lines in FIG. 2, each support wall 58 is disposed (is stood up) in a state orthogonal to the back face 46D of the ramp body 46.

In the deployed state, as illustrated by the solid lines in FIG. 1, each support wall 58 has a substantially triangular shape in side view, and each support wall 58 is formed such that the height thereof decreases on progression from the rear end (one extension direction end portion of the ramp body) 46B to the leading end (another extension direction end portion of the ramp body) 46A of the ramp body 46. Namely, a free end portion (lower end) 58A of each support wall 58 makes contact with the ground contact surface GL in a state disposed running along the extension direction of the ramp body 46.

In a state in which the free end portion 58A of each support wall 58 has made contact with the ground contact surface GL, the angles of the hinge panels 48, 50 with respect to the ramp face 46C of the ramp body 46 are adjusted via the hinges 52, 54 such that a leading end 48B of the hinge panel 48 makes contact with the ground contact surface GL.

As illustrated in FIG. 2, the hinged wall 60 is provided, via hinges 64, to the free end portion 58A of each support wall 58 so as to form a unit. In a state in which the support walls 58 have been deployed, each hinged wall 60, together with the respective support wall 58, forms a closed cross-section 68 of a three-sided pyramid having its apex at the leading end 46A of the ramp body 46 so as to support the ramp body 46 from the lower side.

Figure 3A:
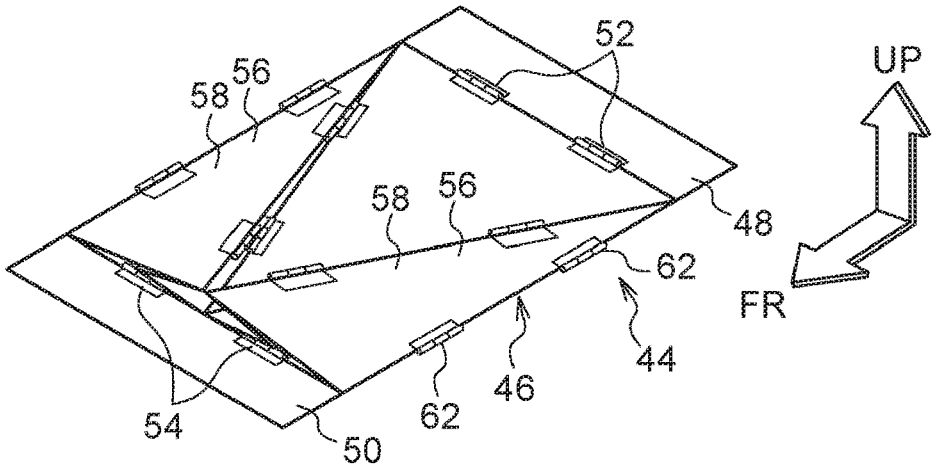
FIG. 3A is a perspective view illustrating a ramp according to the first exemplary embodiment in a state in which a support member is in the process of being stowed or in the process of being deployed, as viewed obliquely from a back face side and from a rear end side.
Figure 3B:
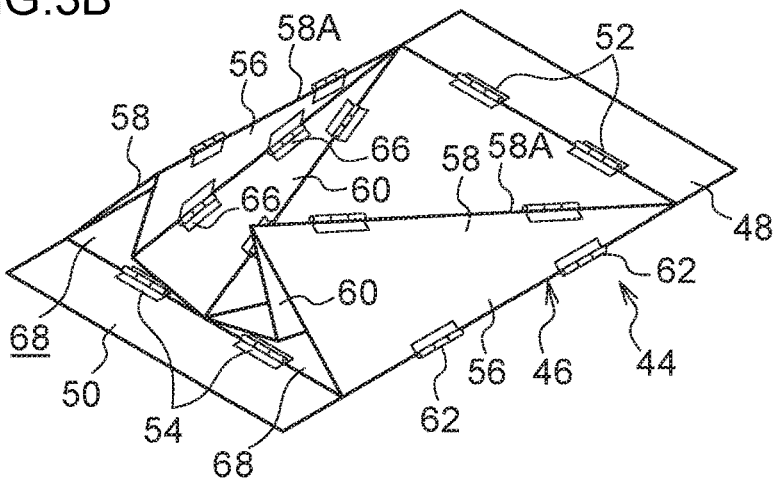
FIG. 3B is a perspective view illustrating a ramp according to the first exemplary embodiment in a state in which a support member is in the process of being stowed or in the process of being deployed, as viewed obliquely from a back face side and from a rear end side.
Figure 3C:
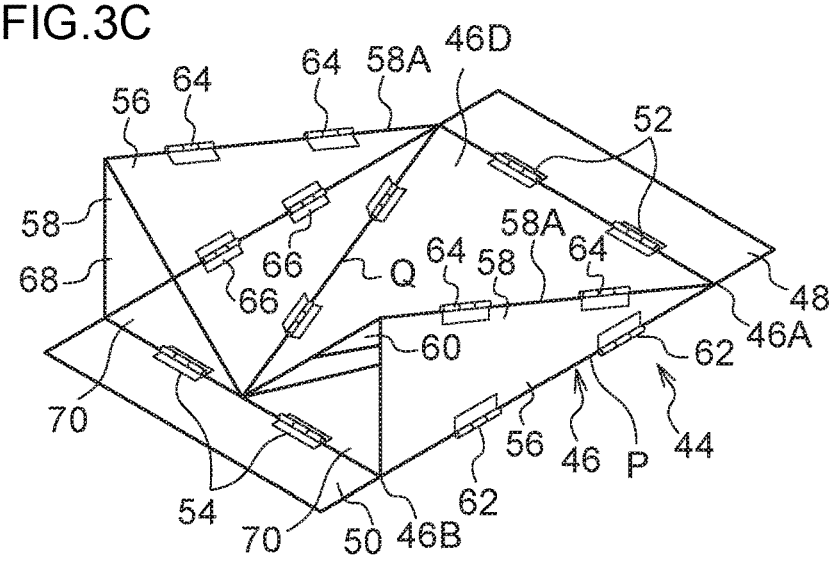
FIG. 3C is a perspective view illustrating a ramp according to the first exemplary embodiment in a state in which a support member has been deployed, as viewed obliquely from a back face side and from a rear end side.

Note that FIG. 3A to FIG. 3C are perspective views of the ramp 44 as viewed obliquely from the back face 46D side and from the rear end side (the rear end 46B side of the ramp body 46). FIG. 3A and FIG. 3B illustrate states in which the support member 56 is in the process of being stowed or in the process of being deployed, and FIG. 3C illustrates a state in which the support member 56 has been deployed. Note that for simplicity, the ramp 44 is represented using line drawings.

As illustrated in FIG. 2 and FIG. 3C, hinges 66 are provided at the height direction center of each hinged wall 60. As illustrated in FIG. 3B, each hinged wall 60 is configured so as to be capable of folding toward the inside of the closed cross-section 68 about the hinges 66.

As illustrated in FIG. 3C, a triangular recess 70 (see FIG. 2) is provided to the back face 46D side of the ramp body 46 at each width direction side of the ramp body 46. Each recess 70 is formed with a straight line P that extends across substantially the entire extension direction range of the ramp body 46 at a width direction end portion of the ramp body 46, and a straight line Q that links a width direction central portion of the ramp body 46 at the rear end 46B of the ramp body 46 and a width direction end portion of the ramp body 46 at the leading end 46A of the ramp body 46.

In a state in which the hinged walls 60 of the support members 56 have been folded inward via the hinges 66, as illustrated by the double-dotted dashed lines in FIG. 2, the support walls 58 are overlapped with the hinged walls 60 via the hinges 64, and the support members 56 are stowed in the recesses 70. In addition, a triangular protrusion 72 is provided between the recess 70 and the recess 70 that are adjacent in the width direction of the ramp body 46. The protrusion 72 is set such that in a state in which the support members 56 are stowed in the recesses 70, an outer face 58B of each support wall 58 and the surface (the back face 46D of the ramp body 46) of the protrusion 72 are substantially co-planar.

Operation and Effects of the Vehicle Ramp Device

As illustrated by the solid lines in FIG. 1, the ramp 44 is able to be deployed when the tailgate 18 is opened. To explain in detail, the ramp 44 is swung upwards and toward the vehicle rear about the shafts 43 of the connecting portions 42 provided at the free end portion 18A of the tailgate 18 such that the leading end 48B of the hinge panel 48 makes contact with the ground contact surface GL.

When this occurs, the support members 56 stowed at the back face 46D side of the ramp body 46, as illustrated by the double-dotted dashed lines in FIG. 2, are deployed. Namely, the support walls 58 of the support members 56 are swung about the hinges 62 toward the width direction outer sides of the ramp body 46. Then, the support walls 58 are stood up and the free end portions 58A of the support walls 58 contacted with the ground contact surface GL, as illustrated by the solid lines in FIG. 2. When the support walls 58 stand out in this manner, the hinged walls 60 extend toward the outside of the respective closed cross-section 68 via the hinges 66 so as to stand out and support the ramp body 46 from the lower side together with the support walls 58.

As described above, the hinge panels 48, 50 are respectively provided, via the hinges 52, 54, to the leading end side and the rear end side of the ramp body 46 illustrated in FIG. 1, and the hinge panels 48, 50 are configured such that the angles formed with the ramp face 46C of the ramp body 46 are adjustable. As illustrated by the solid lines in FIG. 1, configuring the angles formed between the hinge panels 48, 50 and the ramp face 46C so as to be adjustable enables dimensional adjustments to be made between the height of the support members 56 (H dimension) and the extension direction length of the ramp body 46 (L dimension).

In a state in which the free end portions 58A of the support walls 58 have made contact with the ground contact surface GL, the angles formed between the hinge panels 48, 50 and the ramp face 46C of the ramp body 46 are adjusted via the hinges 52, 54 such that the leading end 48B of the hinge panel 48 is reliably contacted with the ground contact surface GL.

The floor section 34 of the loading compartment 30, the ramp face 36A of the tailgate inner panel 36, the ramp face 44A of the ramp 44 of the vehicle 10, and the ground contact surface GL are thereby made continuous with each other. Note that herein, "continuous" does not necessarily mean that these surfaces are linked together in a single plane, and slight steps may arise between these members so long a ramp that can be traversed by a person, a wheelchair, or the like is formed bridging between the floor section 34 of the loading compartment 30 of the vehicle 10 and the ground contact surface GL.

As illustrated by the double-dotted dashed lines in FIG. 1, in a state in which the tailgate 18 has been closed, the ramp 44 is able to be stored at the loading compartment 30 side about the shafts 43 of the connecting portions 42. As described above, the ramp 44 is configured including the ramp body 46 and the hinge panels 48, 50, and the hinge panel 48 and the hinge panel 50 are configured such that the angles formed with the ramp face 46C of the ramp body 46 can be adjusted via the hinges 52, 54.

Thus, in a state in which the ramp 44 has been stored in the loading compartment 30, by disposing each of the hinge panels 48, 50 substantially vertically, the ramp body 46 can be disposed substantially horizontally. Note that in this configuration it is necessary to stow the support members 56 against the ramp body 46, and the hinges 66 of the hinged wall 60 are pressed toward the inside of the closed cross-sections 68 using a predetermined amount of force or greater when stowing the support members 56.

As illustrated in FIG. 3B, the hinged walls 60 are folded toward the inside of the closed cross-section 68, and as illustrated in FIG. 3A, the support walls 58 are overlapped on the hinged walls 60, thereby folding the support members 56. In this state, as illustrated by the double-dotted dashed lines in FIG. 2, the support members 56 are stored and stowed in the recesses 70 provided at the back face 46D side of the ramp body 46. The outer faces 58B of the support walls 58 and the back face 46D of the ramp body 46 are set so as to be are substantially co-planar to each other when this has been performed.

Thereby disposing the ramp body 46 substantially horizontally enables objects (not illustrated in the drawings) to be placed on the ramp body 46. Note that setting is made such that the hinged walls 60 do not fold toward the inside of the closed cross-sections 68 when the hinges 66 are pressed using less than the predetermined amount of force.

As explained above, in the first exemplary embodiment, as illustrated by the solid lines in FIG. 1, when the ramp 44 is used, the ramp 44 is supported by the support members 56 from the lower side. The support members 56 are provided so as extend across substantially the entire extension direction range of the ramp body 46, and the support members 56 are configured so as to be able to be deployed and stowed.

As for the support walls 58 configuring part of the support members 56, in a state in which the ramp 44 has been deployed, the free end portions 58A of the support walls 58 that form triangular shapes in side view are disposed running along the extension direction of the ramp 44 so as to make contact with the ground contact surface GL, and the ramp 44 is supported by the support members 56 from the lower side in this state.

For example, although not illustrated in the drawings, in cases in which support portions to support a ramp body are provided only at an extension direction central portion of the ramp body, load acting on the ramp body is concentrated at the extension direction central portion of the ramp through the support portions. Moreover, since support portions are not provided between an extension direction front end portion of the ramp body and the support portions, or between an extension direction rear end portion of the ramp body and the support portions, there is a concern regarding flexure of the ramp body in these regions. If the plate thickness of the ramp body is increased in an attempt to raise the rigidity of the ramp body so as to alleviate this concern, the weight of the ramp body is increased by a commensurate amount.

In contrast thereto, in the first exemplary embodiment, as described above, since the support members 56 illustrated by the solid lines in FIG. 1 are disposed so as to extend across substantially the entire extension direction range of the ramp body 46, load acting on the ramp body 46 is commensurately dispersed, consequently enabling the support rigidity of the ramp body 46 to be raised.

Namely, in the first exemplary embodiment, disposing the support members 56 along the extension direction of the ramp body 46 enables support force to be obtained over a wide range of the ramp body 46, and enables the suppression of flexure in the ramp body 46. Namely, the overall rigidity of the ramp 44 with the support members 56 is increased, thus enabling the plate thickness of the ramp body 46 to be thinned by a commensurate amount. This enables the weight of the ramp 44 to be reduced. Accordingly, the ramp 44 of the first exemplary embodiment enables support rigidity to be raised.

Moreover, in the first exemplary embodiment, the support members 56 that run along the extension direction of the ramp body 46 and make contact with the ground contact surface GL are provided to the ramp body 46. Thus, sufficient support force is able to be obtained by the ramp 44 of the first exemplary embodiment, increasing stability when a person or an object travels over the ramp face 44A.

Moreover, in the first exemplary embodiment, the support members 56 are configured including the support walls 58 and the hinged walls 60, and configuration is such that the free end portions 58A of the support walls 58 make contact with the ground contact surface GL in a state in which the support members 56 have been deployed. Configuration is also such that the hinged walls 60 form the closed cross-sections 68 together with the support walls 58 in the state in which the support members 56 have been deployed. Forming the closed cross-sections 68 with the support walls 58 and the hinged walls 60 in the deployed state of the support members 56 enables support force to be increased when the ramp 44 is used.

Moreover, the hinged walls 60 are provided with the hinges 66, and the hinged walls 60 are folded toward the inside of the closed cross-sections 68 when stowing the support members 56. Namely, when stowing the support members 56, the hinged walls 60 fold inward accompanying rotating of the support walls 58, thereby enabling the support members 56 to be folded in a simple manner.

Note that in the first exemplary embodiment, although each support member 56 is configured including the hinged wall 60 in addition to the support wall 58, the hinged wall 60 is not strictly necessary.

Moreover, in the first exemplary embodiment, the hinge panels 48, 50 are respectively provided, via the hinges 52, 54, to the leading end 46A and the rear end 46B of the ramp body 46, and the hinge panels 48, 50 are configured such that the angles formed with the ramp face 46C of the ramp body 46 are adjustable.

This enables dimensional adjustments to be made between the height (H) of the support members 56 and the extension direction length (L) of the ramp body 46. For example, in cases in which the length (L) of the ramp body 46 is shorter than a preset length with respect to the height (H) of the support members 56, the angles formed between the ramp face 46C of the ramp body 46, the ramp face 48A of the hinge panel 48, and the ramp face 50A of the hinge panel 50 become smaller, and in cases in which the length (L) of the ramp body 46 is longer than the preset length, these angles become larger.

Namely, the angles formed between the ramp face 48A of the hinge panel 48, the ramp face 50A of the hinge panel 50, and the ramp face 46C of the ramp body 46 are adjusted via the hinge panels 48, 50, and dimensional adjustments between the height (H) dimension of the support members 56 and the extension direction length (L) dimension of the ramp body 46 are made via the hinge panels 48, 50. This enables the free end portions 58A of the support walls 58 to be reliably contacted with the ground contact surface GL, and enables the leading end 48B of the hinge panel 48 to be reliably contacted with the ground contact surface GL.

Moreover, in the first exemplary embodiment, as illustrated in FIG. 2, the hinges 62 are provided at each width direction end of the ramp body 46, the support walls 58 are able to be swung in the width direction of the ramp body 46 about the hinges 62, and in a state in which the support walls 58 have been swung toward the width direction inner side of the ramp body 46, the support members 56 are folded up and stowed in the recesses 70 in the back face 46D of the ramp body 46.

Namely, the support members 56 are able to be stowed or deployed using a simple configuration. Stowing the support members 56 in a state folded against the ramp body 46 improves the storability of the ramp 44 compared to cases in which the support members 56 do not fold up. Moreover, providing the recesses 70 in the back face 46D of the ramp body 46 and stowing the support members 56 in the recesses 70 enables the ramp 44 to be made more compact.

Further, in the first exemplary embodiment, the support members 56 are stowed in a state folded against the ramp body 46, and the support members 56 are deployed in the width direction of the ramp body 46 when deploying the ramp body 46. Namely, from the stowed state, the support members 56 are deployed from the inner side toward the outer side in the width direction of the ramp body 46.

Modified Example of the First Exemplary Embodiment

Figure 4:
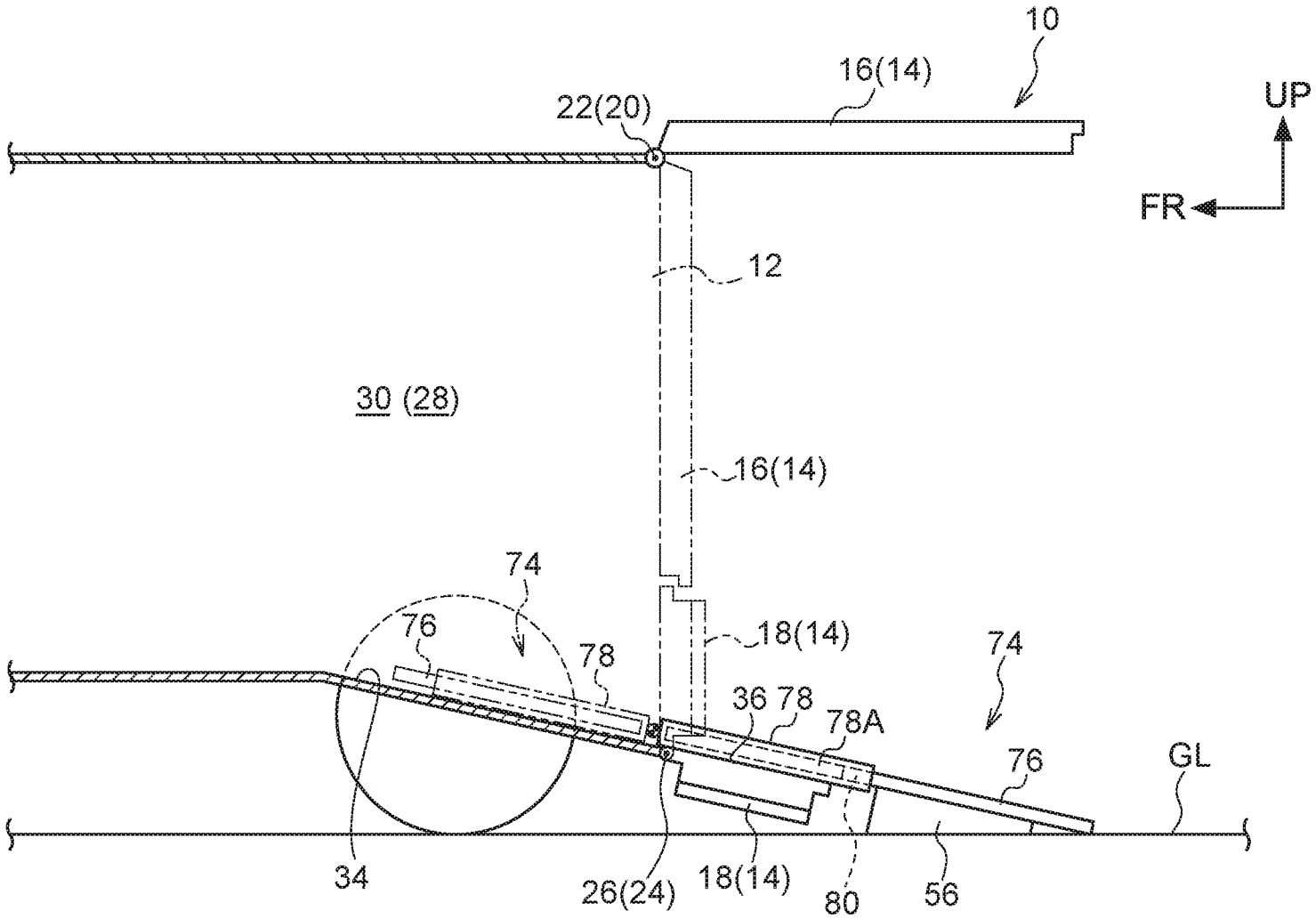
FIG. 4 is a schematic side view of a modified example of a vehicle ramp device according to the first exemplary embodiment, in which a deployed state of a ramp is illustrated using solid lines and a stowed state of the ramp is illustrated using double-dotted dashed lines.

As illustrated in FIG. 1, in the first exemplary embodiment, the tailgate inner panel 36 configures a ramp face 36A that is continuous with the ramp face 44A of the ramp 44, and the ramp 44 is employed as a ramp that bridges between the free end portion 18A of the tailgate 18 when opened and the ground contact surface GL. However, there is no limitation thereto. For example, as illustrated in FIG. 4, a ramp 74 may be employed to bridge between a lower peripheral portion of the back door opening 12 and the ground contact surface GL.

However, such a configuration results in a longer stroke than that of the ramp 44 illustrated in FIG. 1. Accordingly, in FIG. 4, in addition to a ramp portion 76 (a second ramp member), the ramp 74 is configured including a ramp portion 78 (a first ramp member) disposed over the tail gate inner panel 36.

Similarly to with the ramp 44, the support members 56 are able to be stowed at the back face side of the ramp portion 76. A rail 80 that runs along the extension direction of the ramp 74 is provided at each width direction sidewall 78A of the ramp portion 78, thereby enabling sliding of the ramp portion 76. The ramp portion 76 is thus able to be stored in the ramp portion 78 in a state in which the support members 56 are stowed in the ramp portion 76. The ramp portion 78 and the ramp portion 76 thereby overlap in their plate thickness directions, thus configuring a stowed state.

In this manner, the ramp 74 according to the first exemplary embodiment is stowed overlapping with the ramp portion 76, which stows the support members 56, its plate thickness direction, thereby enabling the ramp portion 78, the ramp portion 76, and the support members 56 to be compactly consolidated in the plate thickness direction. The ramp 74 thus has excellent storability.

As described above, in the first exemplary embodiment, in a state in which the ramp portion 78 is placed on the ground contact surface GL (or over the tailgate inner panel 36), the ramp 74 is able to be stowed and deployed just by sliding the ramp portion 76 along the rails 80 of the ramp portion 78. Accordingly, convenience is increased compared to cases not illustrated in the drawings in which, for example, the ramp portion 76 is swung with respect to the ramp portion 78 so as to be stowed or deployed.

Note that in a configuration in which the ramp portion 76 is swung with respect to the ramp portion 78 so as to be stowed or deployed, the ramp portion 78 and the ramp portion 76 are merely overlapped in the plate thickness direction. In contrast present embodiment enables the ramp to be configured simply, and so such a configuration is useful in cases in which the stroke of the ramp is short.

For example, although in the first exemplary embodiment explanation was given using an example in which the ramp 44 is connected to the tailgate 18 so as to configure the vehicle ramp device 32, as illustrated in FIG. 1, there is no limitation thereto. The ramp 44 can also simply be used as a ramp, namely, a member that bridges two planes provided at different heights, may be employed.

Second Exemplary Embodiment

Vehicle Ramp Device Configuration

Explanation follows regarding a vehicle ramp device according to a second exemplary embodiment of the present application. Note that explanation of any operation and effects that is substantially the same as that of the first exemplary embodiment is omitted.

Figure 5:
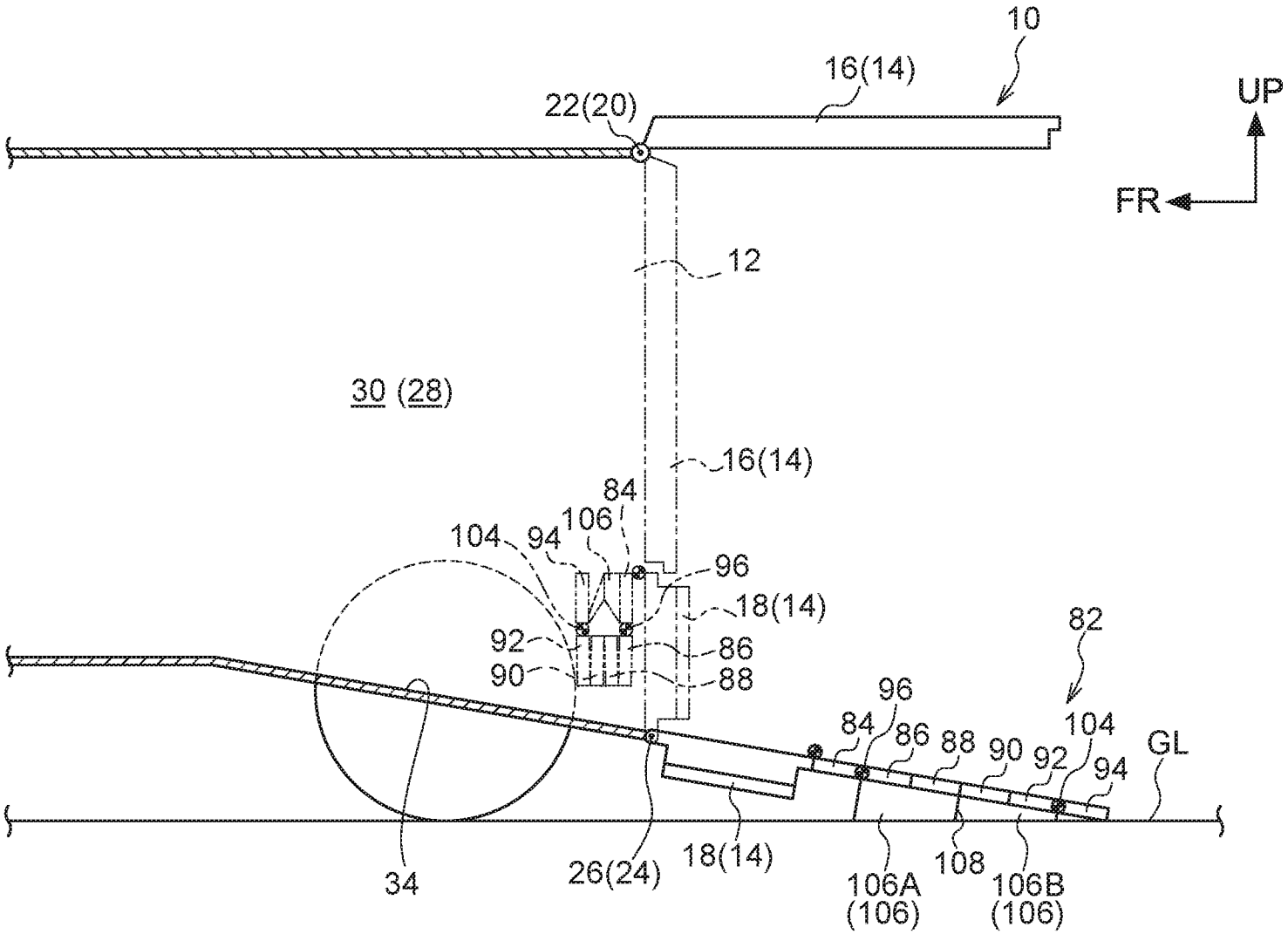
FIG. 5 is a schematic side view of a vehicle ramp device according to a second exemplary embodiment, in which a deployed state of a ramp is illustrated using solid lines and a stowed state of the ramp is illustrated using double-dotted dashed lines.

As illustrated in FIG. 5, a ramp 82 is configured including six hinge panels 84, 86, 88, 90, 92, 94 that run along the extension direction of the ramp 82. Hinge panel 84 and hinge panel 86, hinge panel 86 and hinge panel 88, hinge panel 88 and hinge panel 90, hinge panel 90 and hinge panel 92, and hinge panel 92 and hinge panel 94 are respectively connected together by butterfly hinges (first fold lines) 96, 98, 100, 102, 104. The ramp 82 of the second exemplary embodiment is thereby able to compress and fold up in the extension direction of the ramp 82.

Figure 6A:
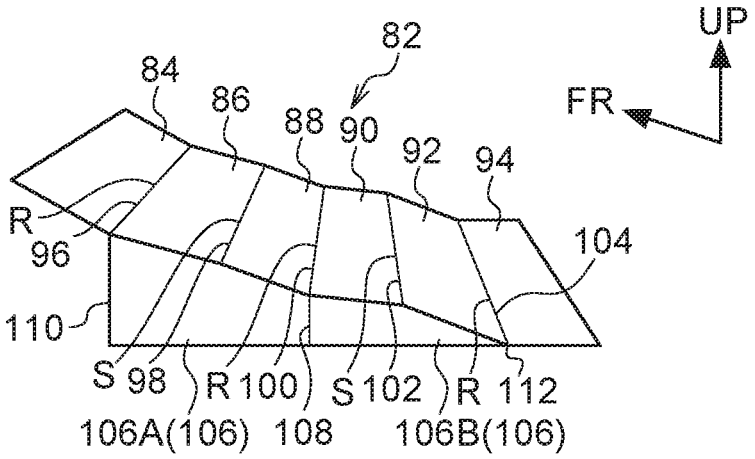
FIG. 6A is a perspective view illustrating a ramp according to the second exemplary embodiment in a state in which the ramp has been deployed, as viewed obliquely from above and to the side.
Figure 6B:
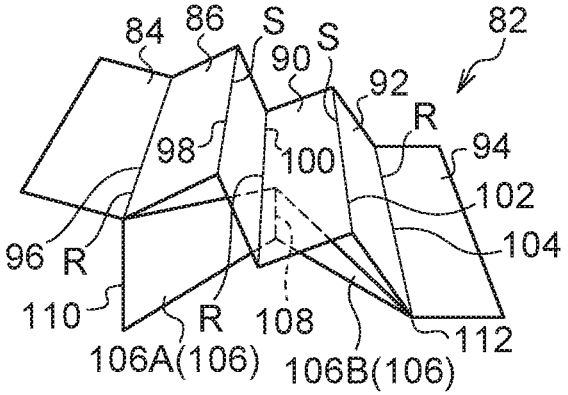
FIG. 6B is a perspective view illustrating a ramp according to the second exemplary embodiment in a state in which the ramp is in the process of being deployed or being folded up, as viewed obliquely from above and to the side.
Figure 6C:
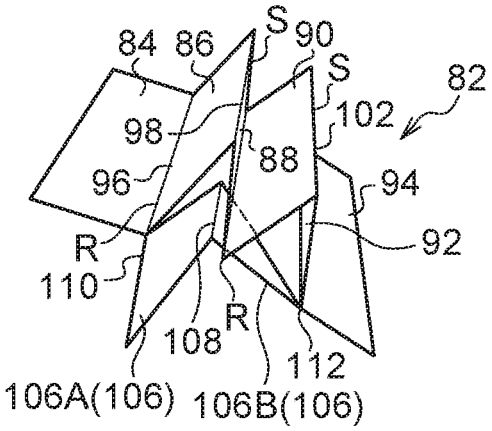
FIG. 6C is a perspective view illustrating a ramp according to the second exemplary embodiment in a state in which the ramp is in the process of being deployed or being folded up, as viewed obliquely from above and to the side.
Figure 6D:
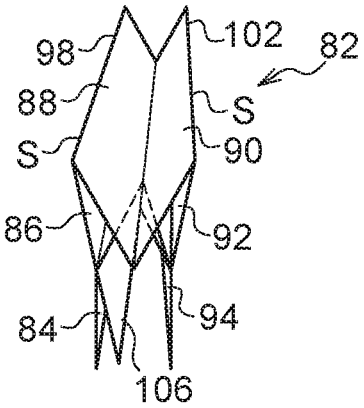
FIG. 6D is a perspective view illustrating a ramp according to the second exemplary embodiment in a state in which the ramp has been folded up, as viewed obliquely from above and to the side.

Note that FIG. 6A to FIG. 6D are perspective views illustrating the ramp 82 obliquely from above and to the side. FIG. 6A illustrates a state in which the ramp 82 has been deployed, and FIG. 6D illustrates a state in which the ramp 82 has been folded up. FIG. 6B and FIG. 6C illustrate states in which the ramp 82 is in the process of being deployed or being folded up. Note again that for simplicity, the ramp 82 is represented using line drawings.

To explain the ramp 82 in more detail, as illustrated in FIG. 6A to FIG. 6D, and as mentioned above, the ramp 82 is configured by the six hinge panels 84, 86, 88, 90, 92, 94 running along the extension direction, and adjacent pairs of the hinge panels 84, 86, 88, 90, 92, and 94 are respectively connected together by the hinges 96, 98, 100, 102, 104. Since the hinge panels 84, 86, 88, 90, 92, 94 are provided running along the width direction of the ramp 82, the ramp 82 is configured so as to be capable of folding about the fold lines running along the width direction into alternating valleys R and peaks S.

Note that as illustrated in FIG. 6D, in a state in which the ramp 82 has been folded up, the hinge 96 and the hinge 104 positioned at the extension direction ends of the ramp 82 form valleys R. Further, as illustrated in FIG. 6A, in a state in which the ramp 82 has been deployed, except for at the hinge panel 84 and the hinge panel 94 positioned at the extension direction ends of the ramp 82, a support member 106 is provided at the lower side of the hinge panels 86, 88, 90, 92.

The support member 106 is configured including hinged walls 106A, 106B. The hinged wall 106A and the hinged wall 106B are connected together by a hinge (second fold line) 108 provided running along the up-down direction (plate thickness direction) of the ramp 82. Hinges 110, 112 that run along the up-down direction of the ramp 82 are respectively provided to one end portion and another end portion in the length direction of the support member 106 (the extension direction of the ramp 82). This enables the support member 106 to be folded to the width direction inner side of the ramp 82.

Figure 7A:
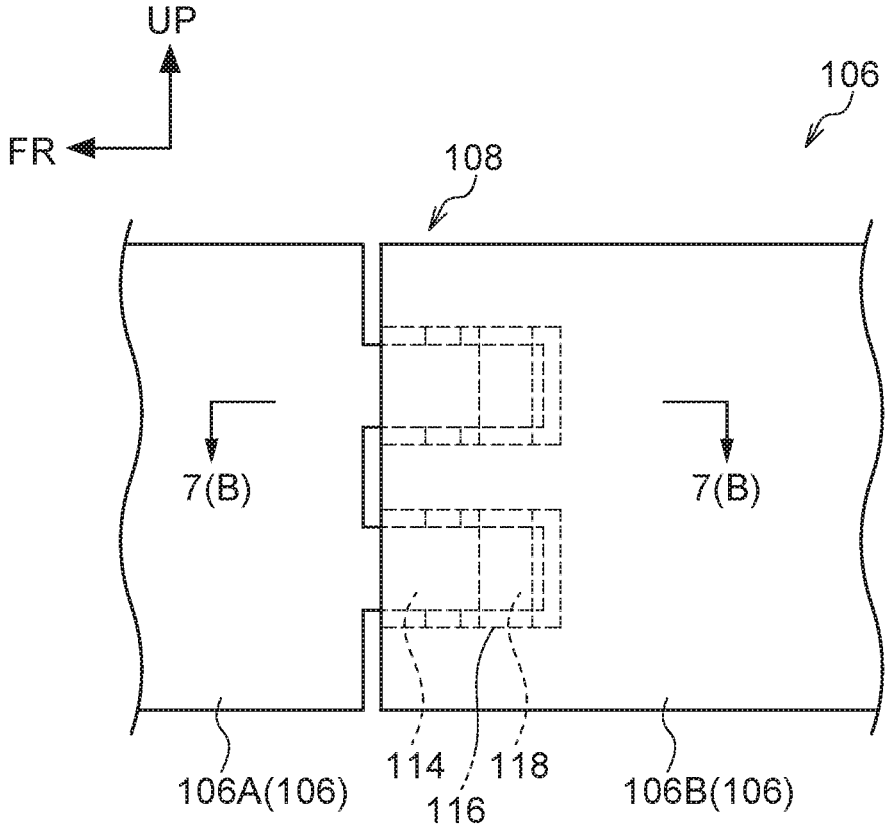
FIG. 7A is an enlarged side view of relevant portions at a hinge of a support member supporting a ramp according to the second exemplary embodiment, as viewed from a width direction inner side of the ramp.
Figure 7B:
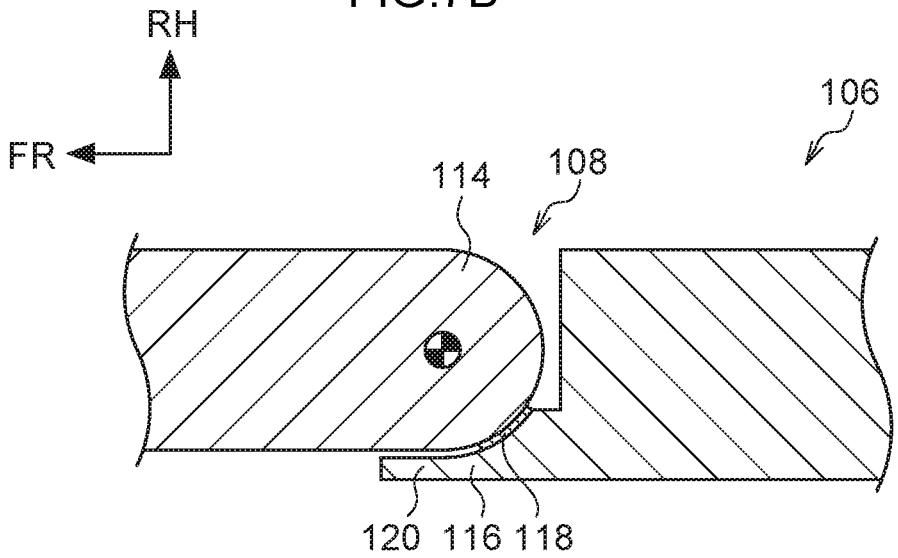
FIG. 7B is a cross-section, sectioned along line 7(B)-7(B) in FIG. 7A, at a hinge of a support member supporting a ramp according to the second exemplary embodiment.

As illustrated in FIG. 7A and FIG. 7B, for example, in the hinge 108, a shaft 114 is provided on the side of the hinged wall 106A of the support member 106 and a shaft bearing 116 that supports the shaft 114 is provided on the side of the hinged wall 106B. A sliding member 118 is provided at a portion of the shaft bearing 116 that contacts the shaft 114, thereby obtaining sliding resistance between the shaft bearing 116 and the shaft 114.

Further, the shaft bearing 116 is provided with a stopper 120 along the trajectory of movement of the shaft 114. Rotating of the hinged wall 106A is restricted by the shaft 114 abutting the stopper 120. Namely, configuration is such that the support member 106 does not fold to the width direction outer side of the ramp 82.

The hinge 108, about which the support member 106 folds, is provided at a different position in the up-down direction of the ramp 82 with respect to the hinges 96, 98, 100, 102, 104 about which the ramp 82 folds, particularly with respect to the hinges 96, 100, 104 forming the valleys R. Configuration is thereby such that when stowing or deploying the ramp 82, the ramp 82 and the support member 106 do not interfere with each other. This enables the support member 106 to be deployed accompanying operation of the ramp 82 when, for example, deploying the ramp 82 after the ramp 82 has been compressed.

Further, in cases in which the ramp 82 is stored in the loading compartment 30 of the vehicle 10 after the ramp 82 has been folded up in the extension direction of the ramp 82 as illustrated in FIG. 6D, the support member 106 of the ramp 82 is disposed at the upper side of the ramp 82, as illustrated by the double-dotted dashed lines in FIG. 5. In such cases, the ramp 82 is stowed (stored) in an upstanding state in the loading compartment 30. In the second exemplary embodiment, the ramp 82 and the support member 106 are configured to compress along the extension direction of the ramp 82 so as to fold up neatly, enabling the ramp 82 to be compactly stowed in the loading compartment 30 and enabling the space in the loading compartment 30 to be increased by a commensurate amount.

Note that in second exemplary embodiment, although the ramp 82 is configured by six hinge panels running along the extension direction, the number of the hinge panels is not limited to six. Further, similarly to in the first exemplary embodiment, the ramp 82 of the second exemplary embodiment may also be configured as a member that bridges two planes provided at different heights.

Explanation has been given regarding exemplary embodiments of the present application. However, embodiments are not limited to the above, and obviously various other modifications may be implemented within a range not departing from the spirit of embodiments.

What is claimed is:

1. A ramp, comprising:

a ramp body having a ramp face and a back face opposite the ramp face; and support members that are provided on the back face, each of the support members comprise a plurality of panels so as to be foldable relative to the back face, and that, when the ramp body is used, are each disposed at a respective width direction end of the ramp body so as to run along an extension direction of the ramp body including at an extension direction central portion of the ramp body, the width direction being orthogonal to the extension direction of the ramp body, the support members respectively forming triangular shapes having heights that decrease on progression from one end portion side to another end portion side in the extension direction of the ramp body in side view, and a lower end of each of the support members making contact with a ground contact surface so as to support the ramp body from a back face side.

2. The ramp of claim 1, wherein at least one of a leading end portion or a rear end portion in the extension direction of the ramp body is provided with a hinge panel that is configured to adjust an angle formed between the hinge panel and the ramp face.

3. The ramp of claim 1, wherein the support members are stowed in a state folded against the back face of the ramp body, and the ramp body is configured so as to be usable in a state in which the support members have been deployed in the width direction of the ramp body.

4. The ramp of claim 1, wherein each of the support members is provided with a first shaft running along the extension direction of the ramp body at the respective width direction end of the ramp body, and the support members are configured so as to be rotatable about the first shafts.

5. The ramp of claim 1, wherein each of the support members comprises:

a support wall that is configured so as to be rotatable in the width direction of the ramp body, and that forms a triangular shape in side view and has a free end portion that makes contact with the ground contact surface in a state in which the support member has been deployed; and a hinged wall that together with the support wall forms a closed cross-section in a state in which the support member has been deployed, and that folds toward an inside of the closed cross-section when stowing the support member.

6. The ramp of claim 1, wherein the ramp body comprises:

a first ramp member; and a second ramp member in which the support members are stowed, and that is configured to adopt a stowed state in which the second ramp member and the first ramp member overlap in a plate thickness direction, the second ramp member sliding relative to the first ramp member along the extension direction of the ramp body so as to deploy to a leading end side of the first ramp member.

7. The ramp of claim 1, further comprising:

a first fold line that is provided at the ramp body, the first fold line being provided running along the width direction of the ramp body, and the first fold line being a point about which the ramp body folds so as to compress in the extension direction; and a second fold line that is provided at the support members at a different position in the plate thickness direction of the ramp body from the first fold line, the second fold line being a point about which the support members fold to a width direction inner side of the ramp body.

8. A vehicle ramp device, comprising:

the ramp of claim 1, the ramp being connected to a connecting portion provided at a rear end of a vehicle;

the vehicle ramp device being configured such that the ramp is rotatable in a vehicle front-rear direction about a shaft provided running along a vehicle width direction at the connecting portion.

9. The vehicle ramp device of claim 8, wherein, in a stowed state of the ramp, the ramp is disposed in an upstanding state in a loading compartment provided at a rear portion of the vehicle.

10. A ramp, comprising:

a ramp body having a ramp face and a back face opposite the ramp face;

support members that are provided on the back face, and that, when the ramp body is used, are each disposed at a respective width direction end of the ramp body so as to run along an extension direction of the ramp body including at an extension direction central portion of the ramp body, the width direction being orthogonal to the extension direction of the ramp body, the support members respectively forming triangular shapes having heights that decrease on progression from one end portion side to another end portion side in the extension direction of the ramp body in side view, and a lower end of each of the support members making contact with a ground contact surface so as to support the ramp body from a back face side;

a first fold line that is provided at the ramp body, the first fold line being provided running along the width direction of the ramp body, and the first fold line being a point about which the ramp body folds so as to compress in the extension direction; and a second fold line that is provided at the support members at a different position in the plate thickness direction of the ramp body from the first fold line, the second fold line being a point about which the support members fold to a width direction inner side of the ramp body.

11. A vehicle ramp device, comprising:

the ramp of claim 10, the ramp being connected to a connecting portion provided at a rear end of a vehicle;

the vehicle ramp device being configured such that the ramp is rotatable in a vehicle front-rear direction about a shaft provided running along a vehicle width direction at the connecting portion.

12. The vehicle ramp device of claim 11, wherein, in a stowed state of the ramp, the ramp is disposed in an upstanding state in a loading compartment provided at a rear portion of the vehicle.

* * * * *